US008077888B2

(12) United States Patent
Trepte

(10) Patent No.: US 8,077,888 B2
(45) Date of Patent: Dec. 13, 2011

(54) POSITIONING AUDIO OUTPUT FOR USERS SURROUNDING AN INTERACTIVE DISPLAY SURFACE

(75) Inventor: Forrest Power Trepte, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 1455 days.

(21) Appl. No.: 11/321,636

(22) Filed: Dec. 29, 2005

(65) Prior Publication Data

US 2007/0160222 A1 Jul. 12, 2007

(51) Int. Cl.
*H04R 5/02* (2006.01)

(52) U.S. Cl. ..... 381/310; 381/61; 381/17; 381/18; 381/77; 381/306; 381/333

(58) Field of Classification Search ..... 381/61, 381/18, 310, 77, 306, 333, 17
See application file for complete search history.

(56) References Cited

U.S. PATENT DOCUMENTS

| | | | | |
|---|---|---|---|---|
| 5,841,993 | A | 11/1998 | Ho | 395/282 |
| 6,222,930 | B1 | 4/2001 | Nakano et al. | 381/307 |
| 6,394,898 | B1 * | 5/2002 | Nagao et al. | 463/6 |
| 6,577,738 | B2 | 6/2003 | Norris et al. | 381/77 |
| 6,934,395 | B2 | 8/2005 | Ito | 381/23 |
| 6,956,954 | B1 | 10/2005 | Takemura et al. | 381/307 |
| 2003/0091195 | A1 | 5/2003 | Godfrey et al. | 381/23 |
| 2004/0156512 | A1 | 8/2004 | Parker | 381/74 |
| 2005/0058314 | A1 | 3/2005 | Lee et al. | 381/335 |

OTHER PUBLICATIONS

Klemmer et al. (Proceedings of the 14th annual ACM symposium on User interface software and technology UIST '01, Nov. 11-14, 2001, 3(2), pp. 1-10).*

"DSA Pilot." EAW, Loud Technologies Inc. 2005. http://www.eaw.com/products/DSA/pilot/. Printed Dec. 14, 2005. 2pp.

Kirk, Robin and Newmarch, Jan. "A Location-aware, Service-based Audio System." School of Network Computing, Monash University, Peninsula Campus, Melbourne, Australia. Abstract, 5pp. <{robin.kirk, jan.newmarch}@infotech.monash.edu>.

Ringel, Morris, Meredith; Morris, Dan; and Winograd, Terry. "Individual Audio Channels with Single Display Groupware: Effects on Communication and Task Strategy." Stanford University. pp. 242-251. <{merrie, dmorris, winograd}@cs.stanford.edu>. Ringel, Morris, Meredith. "Supporting Effective Interaction with Tabletop Groupware." Stanford University. Abstract, 2 pp. <http://www.stanford.edu/~merrie/papers/mmorris-effectiveinteraction2.pdf>.

Schmitz, Michael. "SAFIR—Spatial Audio Framework for Instrumented Rooms." Saarland University, Saarbrücken, Germany. Abstract, 8pp. <Schmitz@cs.uni-sb.de>.

Toole, Floyd E. "Loudspeakers and Rooms-Working Together." 17pp. <http://www.harmanaudio.com/all_about_audio/loudspeakers_rooms.>.

* cited by examiner

*Primary Examiner* — Vivian Chin
*Assistant Examiner* — Paul Kim
(74) *Attorney, Agent, or Firm* — Workman Nydegger

(57) ABSTRACT

For use with an interactive display system having a generally horizontal interactive display surface, four speakers that are disposed at spaced-apart locations within a housing of the system so that a sound field produced by one or more energized speakers is directed outwardly as desired. A personal computer (PC) selectively energizes one or more of the speakers in accord with a predefined criteria so that a direction of the sound field produced is generally consistent with the disposition of a user, or a state of a software application, or a disposition of a virtual object on the interactive display surface. In one embodiment, each of the speakers is mounted in a different side or end of the interactive display system. In another embodiment, the speakers are mounted at the corners of the housing. One or more of the speakers are energized at a time to produce the desired sound field.

20 Claims, 12 Drawing Sheets

POSITIONING AUDIO OUTPUT FOR USERS SURROUNDING AN INTERACTIVE DISPLAY SURFACE

BACKGROUND

Most personal computers (PCs) and laptops include audio speakers to play music and soundtracks for videos, and to play audio files for applications and games. As shown in FIG. 4A (prior art), traditional audio processing for PC applications and games are designed for a single listener 96 positioned in front of the PC with speakers 94*a* and 94*b* disposed on opposite sides of a display monitor 92. A subwoofer speaker (not shown) may also be included to provide enhanced bass response of an acoustic field 98 centered on the listener. Some systems include surround sound speakers, such as two speakers 94*c* and 94*d* that are disposed behind and to the sides of the listener, as shown in FIG. 4B. These surround sound speakers provide enhanced enjoyment by producing a rear surround acoustic field 99.

With at least two speakers, the sound can be panned between the left and right side of the display, giving the listener the impression that sounds are coming from the right or left, or if equal, from the center of the display. With four speakers, the sound can also be panned between the right and left behind the listener and/or between either pair of the front and rear speakers. Four or more speakers can also be used for special audio effects, such as an echo effect that is produced by driving the rear speakers with a slight time delay to give the user the impression of a reverberant sound field in a large chamber, even though the speakers are located in a small room. Head-related transfer function (HRTF) algorithms can also be used to create the impression of sound behind the listener, even when only two speakers 94*a* and 94*b* are provided, as in FIG. 4A. There are a number of techniques for positional audio with various layouts of speakers around a listener. One example is the DirectSound 3-D system used in Microsoft Corporation's Windows™ operating system. Such techniques assume that the listener will be at a certain sweet spot relative to the speakers. The sweet spot is generally at a position in front of the display and approximately at one vertex of an equilateral triangle, with the two front speakers disposed at the other two vertices of the triangle, producing sound field 98.

The conventional approach for positioning speakers assumes that the user will be viewing a generally vertical display and providing input with a conventional keyboard and/or pointing device. However, a new type of interactive display system has been developed that requires a different arrangement of speakers. In this new interactive display system, the display surface displays text and graphic images, just as on a conventional display, but the new interactive display system includes a display surface that is also responsive to objects contacting or proximate to the display surface. For example, a user can touch the display surface with an object or move an object, such as a finger, just over the display surface to provide an input to an application. While other approaches are contemplated, an initial exemplary embodiment employs an optical sensor for sensing objects in contact with or proximate to the display surface. The interactive display surface of the initial exemplary embodiment is rectangular in shape and horizontal. A vertical or angled interactive display could also be used, and the interactive display surface could be round, oval, or some other shape besides rectangular. Furthermore, this exemplary embodiment of the interactive display system is relatively large and the housing for the interactive display surface appears to be a table top. This embodiment was designed to support multiple users surrounding the table or a single user who may approach the table from any side.

Clearly, in determining where speakers should be provided, the interactive display system doesn't conform to the conventional paradigm of a user seated in front of a PC. Several questions arise in regard to implementing an audio system for an interactive display system that is horizontal and can be approached from any side:

- Where should speakers be placed on the interactive display system?
- Since the interactive display surface can be used from multiple sides, how should the audio be adjusted according to a user's position?
- Multiple users may simultaneously be accessing separate applications or taking separate actions in a game or other application, resulting in a cluttered audio landscape. An audio cue played from all speakers on the table may indicate what happened in an application, but not indicate which user provided an input resulting in the cue. It would therefore be desirable to use speaker positioning to create a less cluttered audio landscape. How should this be done?
- When representing a virtual object that emits sound on the display surface, it would be desirable to generate audio in such a way that it will sound like the audio comes from the object's position, and if the object moves, the corresponding sound location should appear to move with the virtual object. How can this feature be implemented?

Accordingly, it would be desirable to develop a novel approach for disposition of speakers useful with a horizontal interactive display system to provide an effective acoustical experience for one or more users of the system. The speakers should be disposed to enable one or more users to experience the acoustical field appropriate to their disposition, regardless of the side of the interactive display surface where the use is located. Further, the sound produced by an application should drive the speakers in such a way as to relate to events in an application with which the sound is associated as well as the position(s) of one or more users around the display.

SUMMARY

A method has been developed for creating an audible sound field in connection with an interactive display system that includes an interactive display surface that is generally horizontal and around which one or more users may be disposed at different locations. The method includes the step of physically coupling more than two audio sources to the interactive display system, at spaced-apart points around the interactive display surface. The audible sound sources each produce an audible sound that is directed outwardly from the interactive display surface. Based upon a predefined criteria, at least one specific audio source of the more than two audio sources is selectively energized, so as to create an audible sound field that is logically associated with a state of the predefined criteria. The one or more specific audio sources that are energized as the state of the predefined criteria changes are selected so as to maintain a logical relationship between the audible sound field produced thereby and a changed state of the predefined criteria.

At least one embodiment of the method further includes the step of determining a disposition of at least one user currently interacting with the interactive display surface. The disposition of the at least one user then comprises a current state of the predefined criteria. The at least one audio source is energized so as to generally center the audible sound field about the disposition of the at least one user.

The step of determining the disposition of the at least one user can alternatively include the step of responding to an input by the at least one user occurring through an interaction with the interactive display surface. This input provides an indication of the disposition of the at least one user. The disposition of the at least one user can, for example, be determined by detecting an object positioned by the user proximate to or on the interactive display surface at a point. It is assumed that this point is generally adjacent to the disposition of the at least one user. Accordingly, the method determines that the user is disposed along a line that extends from a center of the interactive display surface outwardly through the point. The step of selectively energizing can then include the step of either energizing an audio sound source that is generally disposed on the line that extends from the center of the interactive display surface through the point, or alternatively, energizing two audio sound sources that are disposed on opposite sides of the line.

In another exemplary embodiment, the step of selectively energizing includes the step of detecting a disposition on the interactive display surface of a virtual object that is being displayed by a software application. The virtual object is associated with an audible sound controlled by the software application. Accordingly, the disposition of the viral object corresponds to a current state of the predefined criteria. In response to the disposition of the virtual object on the interactive display surface, the at least one of the audio sound sources is selectively energized, so that the audible sound associated with the virtual object appears to be emanating from the virtual object. In this embodiment, the at least one audio sound sources that is energized changes to produce the audible sound so that a point from which the audio sound appears to emanate moves consistently with a motion of the virtual object over the interactive display surface. Further, in this exemplary embodiment, the audio sound sources are energized as a function of a distance of each audio sound source from the current position of the virtual object, so that an audio sound source that is closer to the current position of the virtual object on the interactive display surface produces a higher volume of the audio sound than an audio sound source that is substantially further away from the current position of the virtual object.

Other aspects of this approach are directed to an interactive display system that produces an audible sound field, and to an interactive display sound system. Both systems include elements that perform functions generally consistent with the steps of the method discussed above.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 6B:
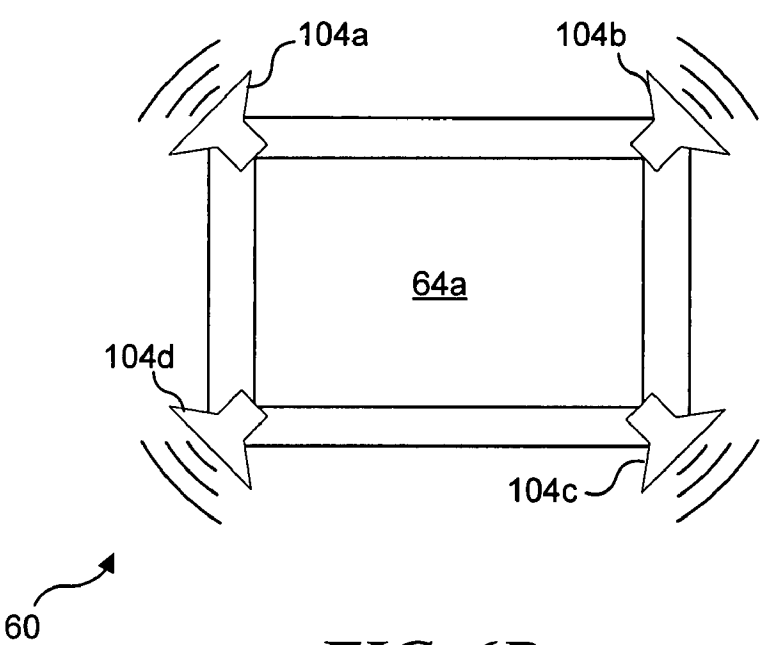
FIG. 6B is a schematic plan view of another exemplary embodiment of the interactive display system, illustrating four speakers, each of which is generally disposed at a different corner of the interactive display surface.
Figure 6A:
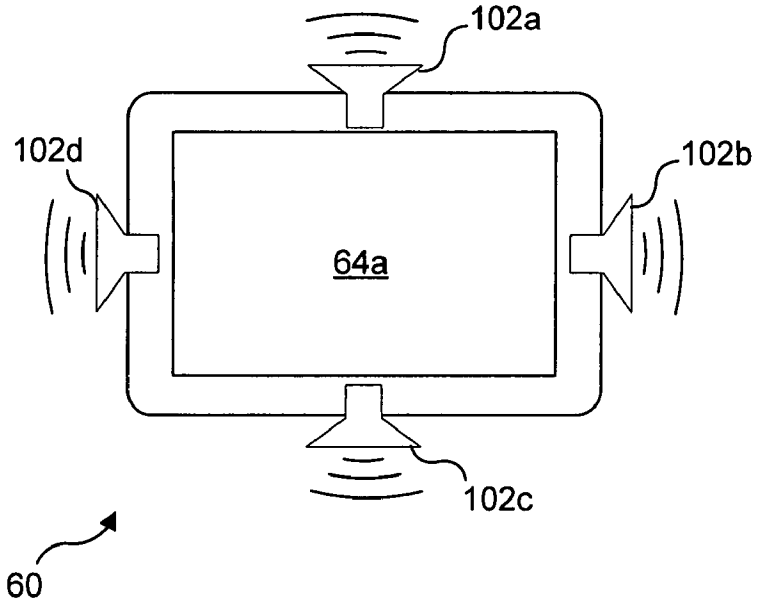
FIG. 6A is a schematic plan view of an exemplary embodiment of the interactive display system, illustrating four speakers, each of which is generally centered in a different one of the four sides of the interactive display surface.
Figure 9A:
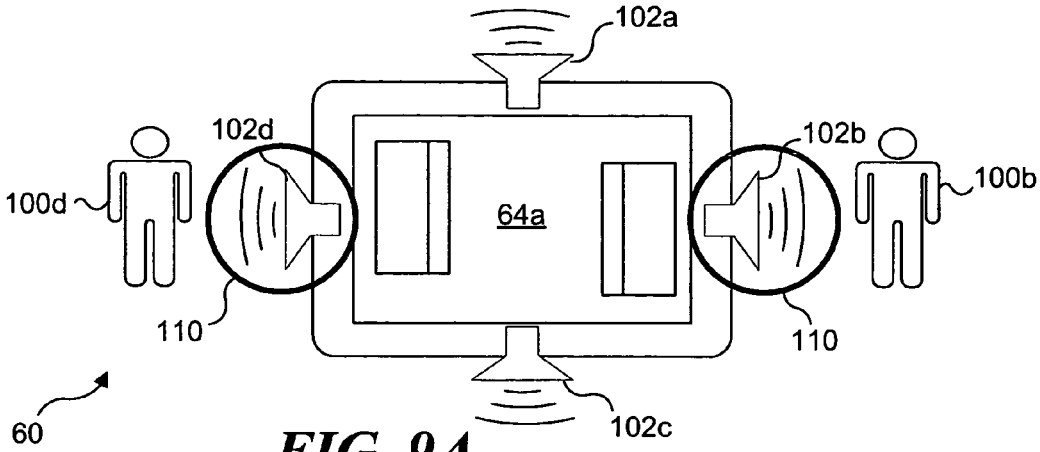
Figure 9B:
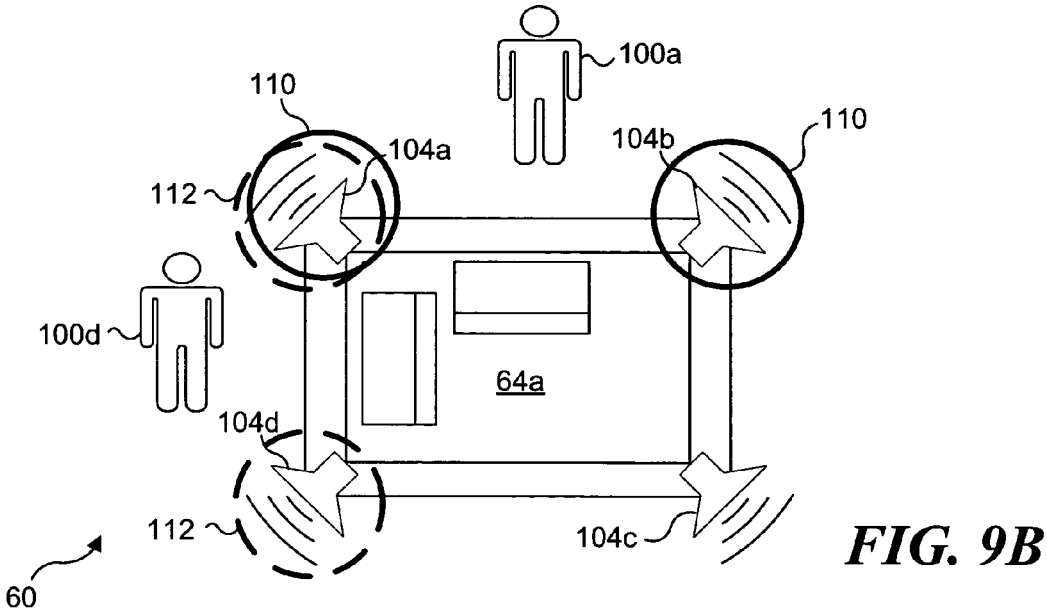
Figure 9C:
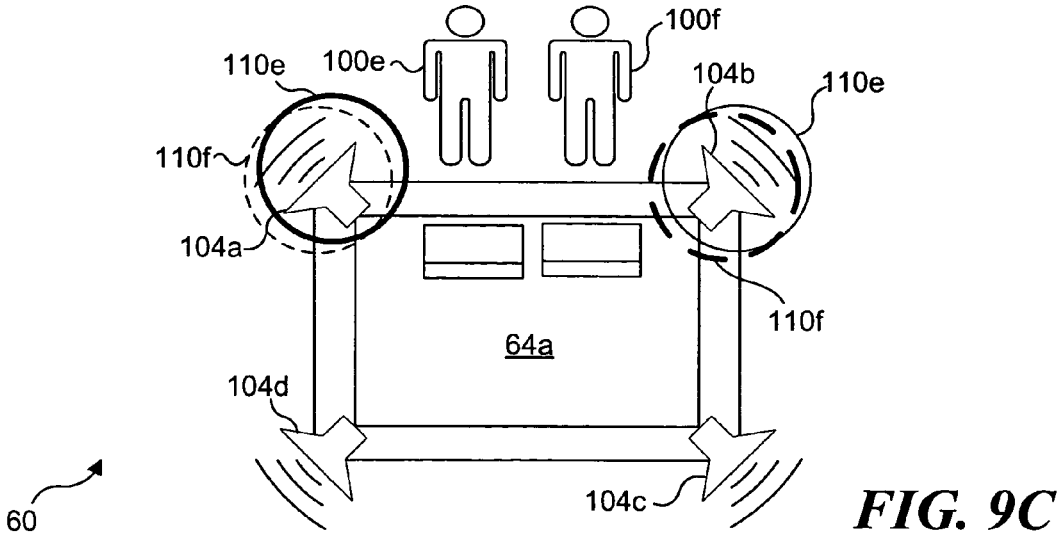
Figure 10:
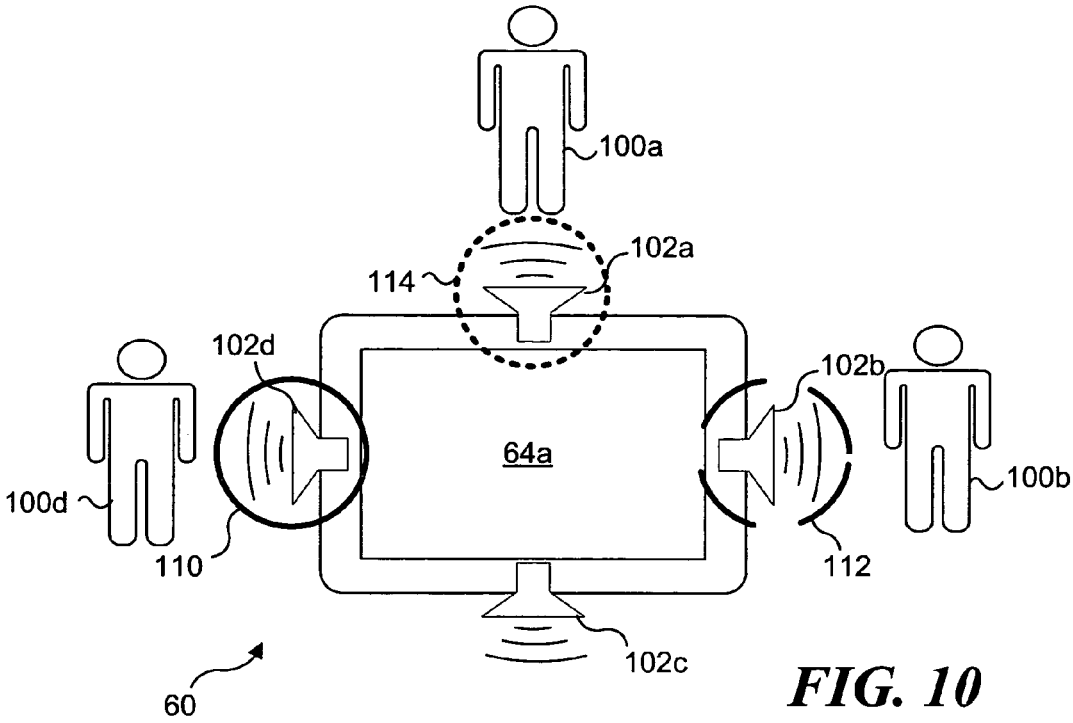
Figure 11A:
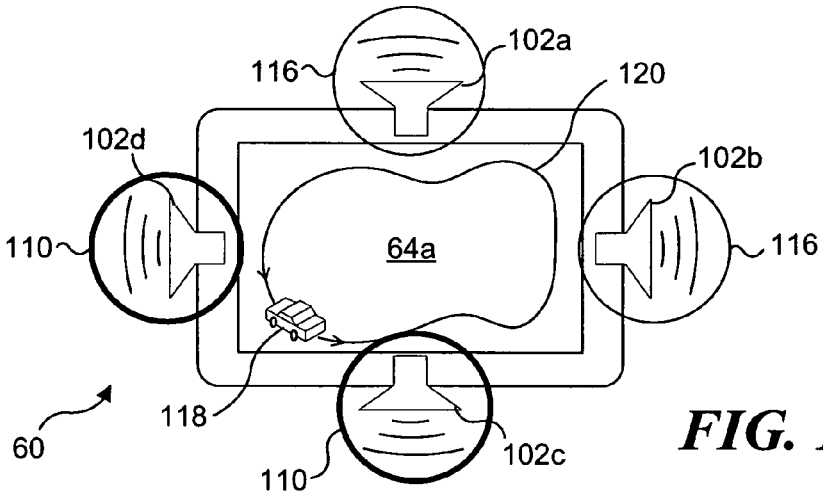
Figure 11B:
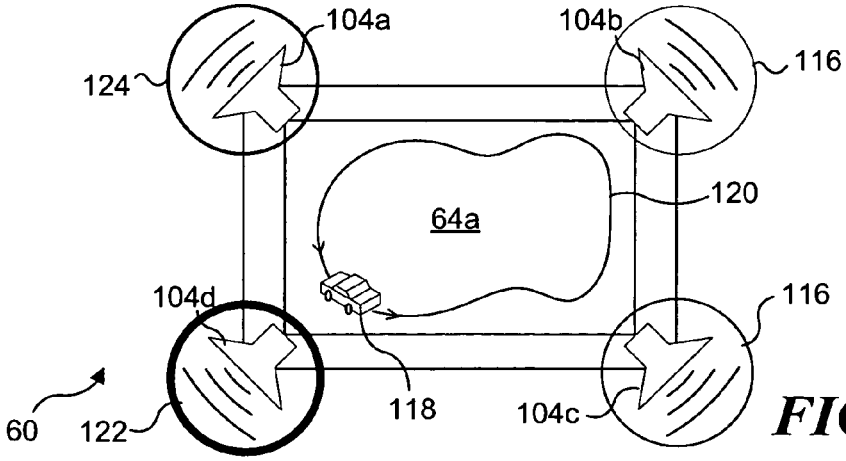
Figure 12A:
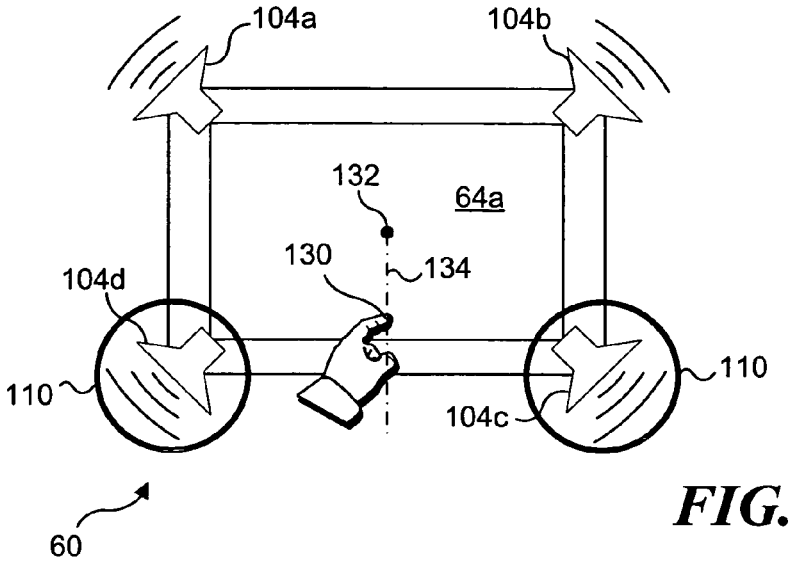
Figure 12B:
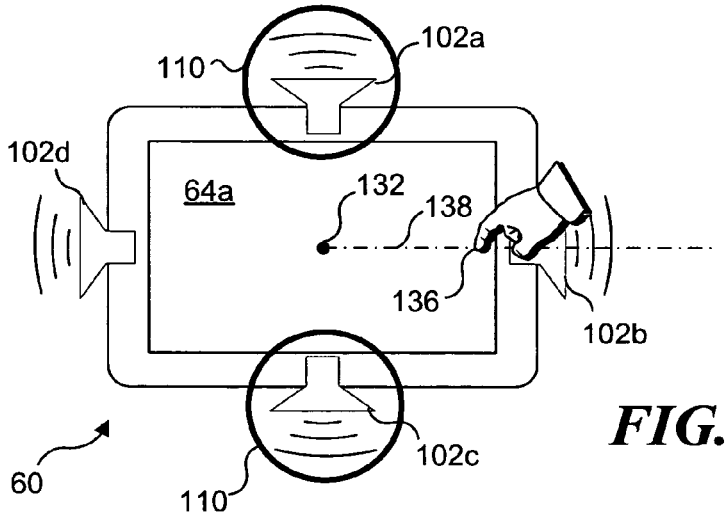
Figure 12C:
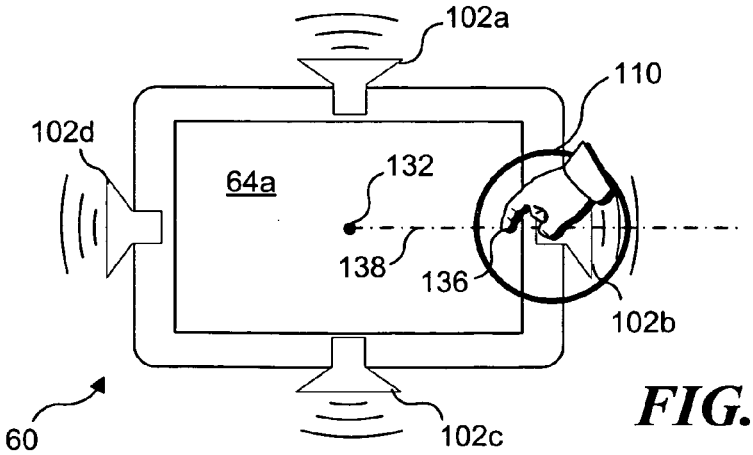
Figure 13:
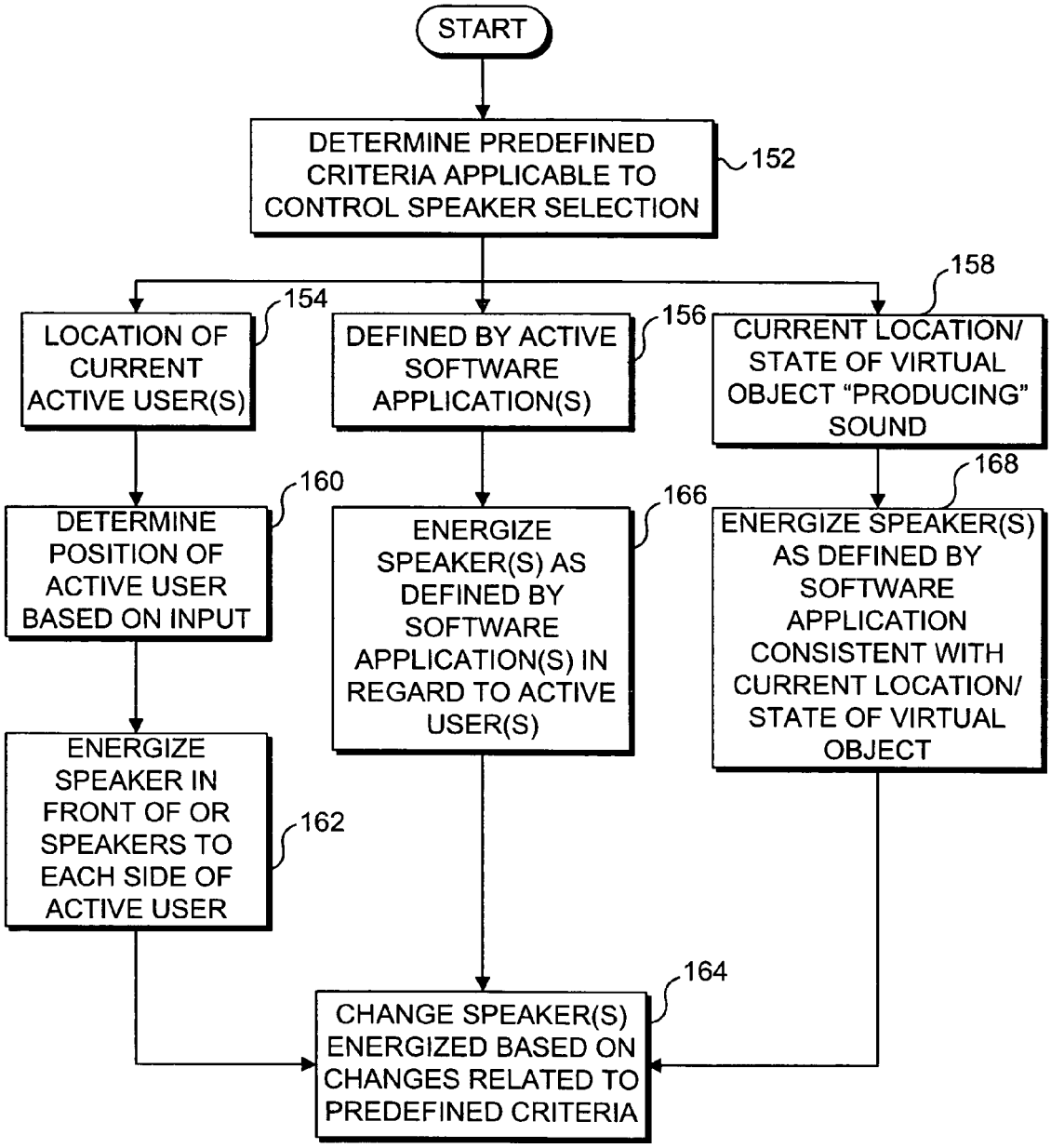

FIGS. 9A and 9B respectively illustrate the embodiments of FIGS. 6A and 6B, showing the speakers that can be selectively energized to provide an appropriate sound field for users disposed at opposite ends (FIG. 9A), and at one end and one side of the interactive display surface (FIG. 9B), in regard to different applications that are being displayed to the two users;

FIG. 9C illustrates the embodiment of FIG. 6B, showing how for the speakers are selectively energized at different volume levels to produce sound fields appropriate for a plurality of users disposed along a common side (or edge) of the interactive display surface;

FIG. 10 illustrates a top plan view of the embodiment of FIG. 6A, showing the three different speakers that can be respectively selectively energized in regard to each of three users that are respectively disposed at opposite ends and along one side of the interactive display surface;

FIGS. 11A and 11B illustrate the embodiments of FIGS. 6A and 6B, showing the relative loudness of sound associated with a virtual object (i.e., a race car) that is running around a virtual track on the interactive display surface, so that the relative loudness of the sound associated with the virtual object produced by each speaker corresponds to the position of the virtual object on the interactive display surface;

FIGS. 12A, 12B, and 12C illustrate both of the embodiments of FIGS. 6A and 6B, showing how an object moved by a user, such as the user's finger, is detected when positioned proximate to or touching the interactive display surface to provide an input, predefined criteria then using a position of the input to determine the speakers that are energized to provide a sound field appropriate for the user; and FIG. 13 is a flow chart that illustrates the logic implemented in selectively energizing one or more speakers in regard to different predefined criteria.

DESCRIPTION

Figures and Disclosed Embodiments are not Limiting

Exemplary embodiments are illustrated in referenced Figures of the drawings. It is intended that the embodiments and Figures disclosed herein are to be considered illustrative rather than restrictive.

Exemplary Computing System

Figure 1:
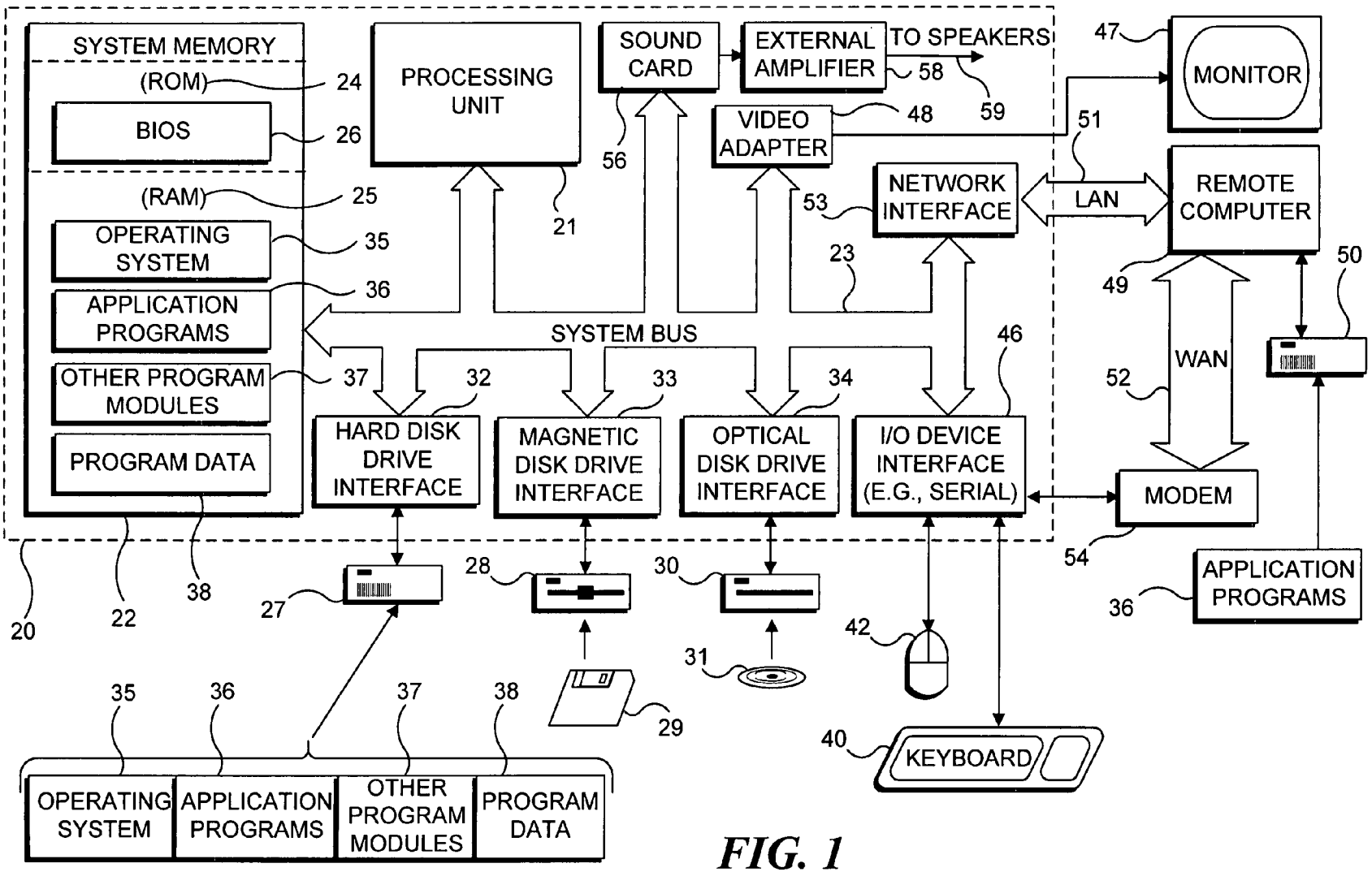
FIG. 1 is a functional block diagram of a generally conventional computing device or PC that is suitable for use with an interactive display surface in practicing the present invention.

FIG. 1 is a functional block diagram of an exemplary computing system for use with an interactive display table or a similar interactive display system having speakers with which an audible sound field can be created in connection with an operating system and/or applications that are being executed on the interactive display system. As used herein and in the claims that follow, the terms "speaker," "loudspeaker," and "acoustic sound source" are generally intended to be generally synonymous and to refer to any device that produces an audible sound propagated through free space toward a user. Specifically excluded by these terms are headphones, speakerbuds, earphones, earpieces, and other audio sound sources of the like that are worn on or in the ears of a user and which are designed to couple audible sound directly into the user's ear canals.

The following discussion is intended to provide a brief, general description of a suitable computing environment in which certain methods may be implemented. Further, the following discussion illustrates a context for implementing computer-executable instructions, such as program modules, with a computing system. Generally, program modules include routines, programs, objects, components, data structures, etc., that perform particular tasks or implement particular abstract data types. The skilled practitioner will recognize that other computing system configurations may be applied, including multiprocessor systems, mainframe computers, personal computers, processor-controlled consumer electronics, personal digital assistants (PDAs) (but likely not when used as a server of digital media content), and the like. Possible implementations include distributed computing environments where tasks are performed by remote processing devices that are linked through a communications network. In a distributed computing environment, program modules may be located in both local and remote memory storage devices.

With reference to FIG. 1, an exemplary system suitable for implementing various methods is depicted. The system includes a general purpose computing device in the form of a conventional PC 20, provided with a processing unit 21, a system memory 22, and a system bus 23. The system bus couples various system components including the system memory to processing unit 21 and may be any of several types of bus structures, including a memory bus or memory controller, a peripheral bus, and a local bus using any of a variety of bus architectures. The system memory includes read only memory (ROM) 24 and random access memory (RAM) 25.

A basic input/output system 26 (BIOS), which contains the fundamental routines that enable transfer of information between elements within the PC 20, such as during system start up, is stored in ROM 24. PC 20 further includes a hard disk drive 27 for reading from and writing to a hard disk (not shown), a magnetic disk drive 28 for reading from or writing to a removable magnetic disk 29, and an optical disk drive 30 for reading from or writing to a removable optical disk 31, such as a compact disk-read only memory (CD-ROM) or other optical media. Hard disk drive 27, magnetic disk drive 28, and optical disk drive 30 are connected to system bus 23 by a hard disk drive interface 32, a magnetic disk drive interface 33, and an optical disk drive interface 34, respectively. The drives and their associated computer readable media provide nonvolatile storage of computer readable machine instructions, data structures, program modules, and other data for PC 20. Although the described exemplary environment employs a hard disk 27, removable magnetic disk 29, and removable optical disk 31, those skilled in the art will recognize that other types of computer readable media, which can store data and machine instructions that are accessible by a computer, such as magnetic cassettes, flash memory cards, digital video disks (DVDs), Bernoulli cartridges, RAMs, ROMs, and the like, may also be used.

A number of program modules may be stored on the hard disk 27, magnetic disk 29, optical disk 31, ROM 24, or RAM 25, including an operating system 35, one or more application programs 36, other program modules 37, and program data 38. A user may enter commands and information in PC 20 and provide control input through input devices, such as a keyboard 40 and a pointing device 42. Pointing device 42 may include a mouse, stylus, wireless remote control, or other pointer, but in connection with the presently described embodiments, such conventional pointing devices may be omitted, since the user can employ an interactive display system for input and control when executing software applications. As used in the following description, the term "mouse" is intended to encompass any pointing device that is useful for controlling the position of a cursor on the screen. Other input devices (not shown) may include a microphone, joystick, haptic joystick, yoke, foot pedals, game pad, satellite dish, scanner, or the like. Also, PC 20 may include a Bluetooth radio or other wireless interface for communication with other interface devices, such as printers, or the interactive display table described in detail below. These and other input/output (I/O) devices can be connected to processing unit 21 through an I/O interface 46 that is coupled to system bus 23. The phrase "I/O interface" is intended to encompass each interface specifically used for a serial port, a parallel port, a game port, a keyboard port, and/or a universal serial bus (USB). System bus 23 can also be connected to a camera interface (not shown), which is coupled to an interactive display 60 in order to receive signals from a digital video camera that is included within interactive display 60, as discussed in greater detail below. The digital video camera may be instead coupled to an appropriate serial I/O port, such as to a USB port. System bus 23 can also be connected through I/O interface 46 or another interface, to a light source within an interactive display in order to provide control signals to the light source, as discussed in greater detail below. Furthermore, system bus 23 can also be connected through I/O interface 46 or another interface to a light detector within an interactive display in order to receive user input. Optionally, a monitor 47 can be connected to system bus 23 via an appropriate interface, such as a video adapter 48; however, the interactive display system described below can provide a much richer display and also interact with the user for input of information and control of software applications and is therefore preferably coupled to the video adaptor. System bus 23 is connected to a sound card 56, which produces a signal that is input to an external amplifier 58. This Figure shows external amplifier 58 within PC 20, but typically, the external amplifier will be disposed outside the PC housing, which is the reason it is referred to in the drawing as being "external." The external amplifier amplifies the signal from the sound card, producing drive signals that are applied to external speakers (not shown in this Figure) through leads 59. The sound card is controlled by the processing unit to produce one or more signals to selectively drive one or more of the speakers, which are selected by the processor in accord with predefined criteria, as described in detail below. In general, PCs can also be coupled to other peripheral output devices (not shown), such as printers.

Certain methods described in detail below, can be practiced on a single machine, although PC 20 can also operate in a networked environment using logical connections to one or more remote computers, such as a remote computer 49. Remote computer 49 can be another PC, a server (which can be configured much like PC 20), a router, a network PC, a peer device, or a satellite or other common network node, (all not shown) and typically includes many or all of the elements described above in connection with PC 20, although only an external memory storage device 50 has been illustrated in FIG. 1. The logical connections depicted in FIG. 1 include a local area network (LAN) 51 and a wide area network (WAN) 52. Such networking environments are common in offices, enterprise-wide computer networks, intranets, and the Internet.

When used in a LAN networking environment, PC 20 is connected to LAN 51 through a network interface or adapter 53. When used in a WAN networking environment, PC 20 typically includes a modem 54, or other means such as a cable modem, Digital Subscriber Line (DSL) interface, or an Integrated Service Digital Network (ISDN) interface for establishing communications over WAN 52, such as the Internet. Modem 54, which may be internal or external, is connected to the system bus 23 or coupled to the bus via I/O device interface 46, i.e., through a serial port. In a networked environment, program modules, or portions thereof, used by PC 20 may be stored in the remote memory storage device. It will be appreciated that the network connections shown are exemplary and other means of establishing a communications link between the computers may be used, such as wireless communication and wide band network links.

Exemplary Interactive Surface

Figure 2:
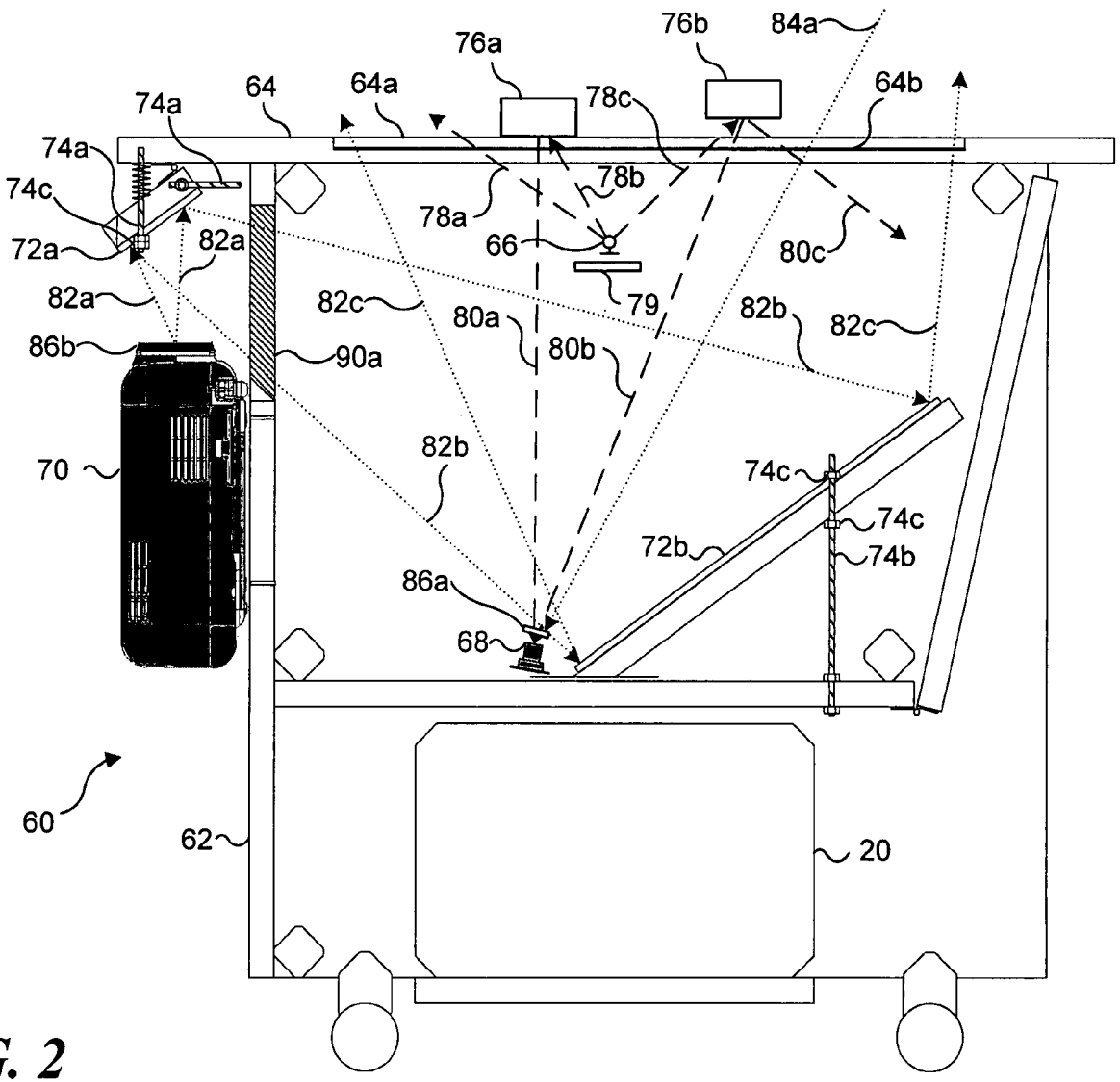
FIG. 2 is a cross-sectional view illustrating internal components of an interactive display system in the form of an interactive display table that includes an integral PC.

In FIG. 2, an exemplary interactive display table 60 is shown that includes PC 20 within a frame 62 and which serves as both an optical input and video display device for the computer. The depicted embodiment is a cut-away figure of one exemplary implementation of interactive display table 60. In the embodiment shown in FIG. 2, rays of light 82*a*-82*c* used for displaying text and graphic images are illustrated using dotted lines, while rays of infrared (IR) light used for sensing objects on or just above an interactive display surface 64*a* of interactive display table 60 are illustrated using dashed lines. The perimeter surrounding a top 64 of the table surface is useful for supporting a user's arms or other objects, including objects such as game pieces, which may be used to interact with the graphic images or virtual environment being displayed on interactive display surface 64*a*. As used herein and in the claims that follow, interactive display surface 64*a* is considered to be horizontal or "generally horizontal" so that a user standing next to the perimeter of the interactive display table would be looking generally down at an acute angle onto the interactive display surface to see images displayed thereon, in contrast to a more convention display, which is typically mounted generally vertically, and is normally viewed by a user looking forward of the user's position in front of the display. In other words, the interactive display surface that is generally horizontal is generally parallel to the floor.

Scanning light source 66 can comprise any of a variety of light emitting devices, such as a light emitting diode (LED), laser diode, and other suitable scanning light sources that are driven to scan in two orthogonal dimensions, i.e., in the X and Y directions. The scanning mechanism used for scanning light source 66 and for each of the other scanning light sources discussed below can be a rotating mirror, a galvanometer mirror, or other well known scanning mechanisms commonly used for producing a raster scan of a surface with a light beam. In general, scanning light source 66 is configured for emitting light having a wavelength in the infrared (IR) spectrum, which is therefore not visible to the human eye. However, any wavelength of light can be used that is invisible to the human eye, so as to avoid interfering with the display of visible images provided on interactive display surface 64*a*. Scanning light source 66 can be mounted in any position on the interior side of frame 62, depending on the particular light source used. The light that is produced by scanning light source 66 is directed upwardly toward the underside of interactive display surface 64*a*, as indicated by dashed lines 78*a*, 78*b*, and 78*c*. Light emitted from scanning light source 66 is reflected from any objects that are on or adjacent to interactive display surface 64*a* after passing through a translucent layer 64*b* of the table, comprising a sheet of vellum or other suitable translucent material with light diffusing properties.

As used in the description and claims that follow, the term "proximate to" is used with the intent that this phrase encompass both an object that is either touching the interactive display surface or is separated from the interactive display surface by short distance, e.g., by up to 3 centimeters or more, depending on factors such as the reflectivity of the object. Although only one scanning light source 66 is shown, it will be appreciated that a plurality of such light sources may be mounted at spaced-apart locations around the interior sides of frame 62 to provide an even illumination of the interactive display surface. The light produced by scanning light source 66 may either exit through the table surface without illuminating any objects, as indicated by dash line 78*a*; illuminate objects on the table surface, as indicated by dash line 78*b*; and/or illuminate objects a short distance above (i.e., proximate to) the interactive display surface but not touching it, as indicated by dash line 78*c*.

Objects above interactive display surface 64*a* include a "touch" object 76*a* that rests "on" or at least partially touches the display surface, and a "hover" object 76*b* that is close to, but not in actual contact with the interactive display surface. Thus, both touch and hover objects can be "adjacent to" the display surface, as that term is used in the following description. As a result of using translucent layer 64*b* under the interactive display surface to diffuse light passing through the interactive display surface, as an object approaches the top of interactive display surface 64*a*, the amount of IR light that is reflected by the object increases to a maximum level when the object is actually in contact with the display surface.

As illustrated in FIG. 2, a light detector 68 is mounted to frame 62 below interactive display surface 64*a*, in a position appropriate to detect IR light that is reflected from a "touch" object or "hover" object disposed above (i.e., adjacent to) the interactive display surface. In general, light detector 68 can be any light detection device suitable for detecting light reflected from objects on or adjacent to interactive display surface 64*a*. For example, light detector 68 can be an area CMOS or area charged coupled device (CCD) sensor. While the implementation shown in FIG. 2 depicts one light detector 68, a plurality of light detectors 68 can be employed within interactive display table 60. Light detector 68 can be equipped with an IR pass filter 86*a* that transmits only IR light and blocks ambient visible light traveling through interactive display surface 64*a* along dotted line 84*a*. In this exemplary implementation, a baffle 79 is disposed between scanning light source 66 and the light detector 68 to prevent IR light that is directly emitted from scanning light source 66 from entering light detector 68, since it is preferable that light detector 68 produce an output signal that is only responsive to IR light reflected from objects that are adjacent to interactive display surface 64*a*. It will be apparent that light detector 68 will also respond to any IR light included in the ambient light that passes through interactive display surface 64*a* from above and into the interior of the interactive display, including ambient IR light that also travels along the path indicated by dotted line 84*a*.

IR light reflected from objects on or above the table surface may be: (a) reflected back through translucent layer 64*b*, through IR pass filter 86*a* and into light detector 68, as indicated by dash lines 80*a* and 80*b*; or, (b) reflected or absorbed by other interior surfaces within the interactive display 60 without entering light detector 68, as indicated by dash line 80*c*.

Translucent layer 64*b* diffuses both incident and reflected IR light. Thus, as explained above, "hover" objects such as hover object 76*b* that are closer to interactive display surface 64*a* will reflect more IR light back to light detector 68 than objects of the same reflectivity that are farther away from the display surface. Light detector 68 senses the IR light reflected from "touch" and "hover" objects within its operating field and produces a detection signal corresponding to the reflected IR light that it receives. This detection signal is input to the PC 20 for processing to determine a location of each such object, and optionally, other parameters such as the size, orientation, shape, and trajectory of the object. It should be noted that a portion of an object, such as a user's forearm, may be above the table while another portion, such as the user's finger, is in contact with the display surface. In addition, other parameters associated with an object may be detected. For example, an object may include an IR light reflective pattern or coded identifier, such as a bar code, on its bottom surface that is specific to that object or to a class of related objects of which that object is a member. Accordingly, the detection signal from one or more light detectors 68 can also be used for detecting each such specific object, as well as determining other parameters of the object or associated with the object, in response to the IR light reflected from the object and/or from a reflective pattern.

Embodiments are thus operable to recognize an object and/or its position relative to the interactive display surface 64*a*, as well as other information, by detecting its identifying characteristics using the reflected IR light from the object. Details of the logical steps implemented to thus detect and identify an object, its orientation, and other parameters are explained in the commonly-assigned patent applications, including application Ser. No. 10/814,577 entitled "Identification Of Object On Interactive Display Surface By Identifying Coded Pattern," and application Ser. No. 10/814,761 entitled "Determining Connectedness And Offset Of 3D Objects Relative To An Interactive Surface," both of which were filed on Mar. 31, 2004. The disclosure and drawings of these two patent applications are hereby specifically incorporated herein by reference (as background information), but are not viewed as essential to or required for enabling the novel approach for controlling audio sound sources claimed below. It must also be emphasized that the specific details discussed herein for enabling the interactive display surface to both display graphic images and text, and to detect input provided with one or more objects placed on or proximate to the interactive display surface should be considered only as exemplary of one preferred approach for providing an interactive display system, since it is also envisioned that other approaches can be employed to provide imaging and input detection capability on an interactive display surface.

Figure 3:
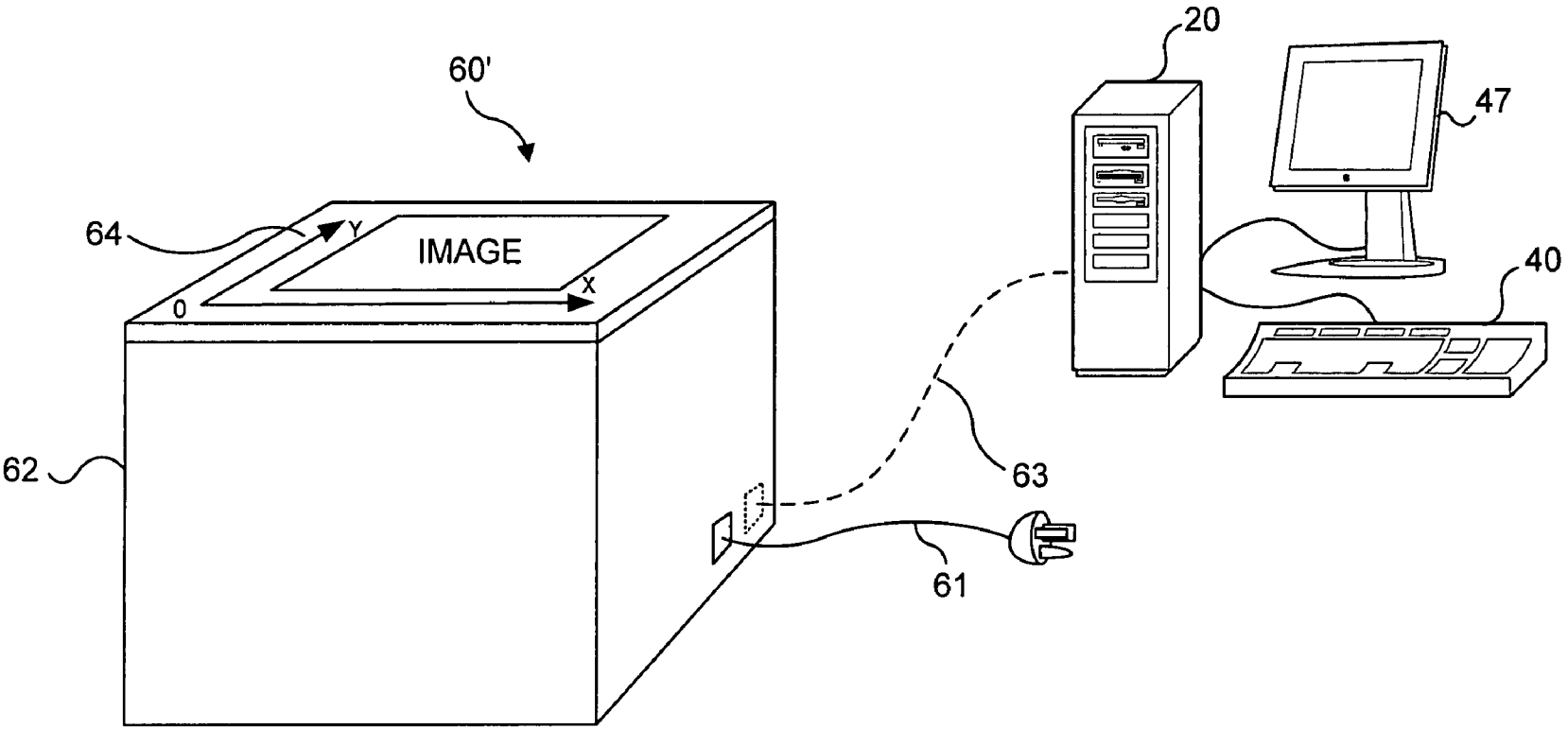
FIG. 3 is an isometric view of an embodiment of an interactive display system in which the interactive display table is connected to an external PC.

PC 20 may be integral to interactive display table 60, as shown in the embodiment of FIG. 2, or alternatively, may instead be external to the interactive display table, as shown in the exemplary embodiment of FIG. 3. In FIG. 3, an interactive display table 60' is connected through a data cable 63 to an external PC 20 (which includes optional monitor 47, as mentioned above). Alternatively, external PC 20 can be connected to interactive display table 60' via a wireless link (i.e., WiFi or other appropriate radio signal link). As also shown in this Figure, a set of orthogonal X and Y axes are associated with interactive display surface 64*a*, as well as an origin indicated by "0." While not discretely shown, it will be appreciated that a plurality of coordinate locations along each orthogonal axis can be employed to specify any location on interactive display surface 64*a*.

If an interactive display table 60' is connected to an external PC 20 (as in FIG. 3) or to some other type of external computing device, such as a set top box, video game, laptop computer, or media computer (not shown), then interactive display table 60' comprises an input/output device. Power for interactive display table 60' is provided through a power lead 61, which is coupled to a conventional alternating current (AC) source (not shown). Data cable 63, which connects to interactive display table 60', can be coupled to a USB2.0 port, an Institute of Electrical and Electronics Engineers (IEEE) 1394 (or Firewire) port, or an Ethernet port on PC 20. It is also contemplated that as the speed of wireless connections continues to improve, interactive display table 60' might also be connected to a computing device, such as PC 20 via such a high speed wireless connection, or via some other appropriate wired or wireless data communication link. Whether included internally as an integral part of the interactive display system, or externally, PC 20 executes algorithms for processing the digital images from the light detector 68 and executes software applications that are designed to employ the more intuitive user interface functionality of interactive display table 60' to good advantage, as well as executing other software applications that are not specifically designed to make use of such functionality, but can still make good use of the input and output capability of the interactive display table. As yet a further alternative, the interactive display system can be coupled to an external computing device, but also include an internal computing device for doing image processing and other tasks that would then not be done by the external PC.

An important and powerful feature of interactive display table 60 or 60' (i.e., of either of the embodiments of the interactive display table discussed above) is its ability to display graphic images or a virtual environment for games or other software applications and to enable a user interaction with the graphic image or virtual environment visible on interactive display surface 64*a*, by identifying objects (or characteristics thereof) that are resting atop the display surface, such as an object 76*a*, or that are hovering just above it, such as an object 76*b*.

Again referring to FIG. 2, interactive display table 60 can include a video projector 70 that is used to display graphic images, a virtual environment, or text information on interactive display surface 64*a*. The video projector can be a liquid crystal display (LCD) or digital light processor (DLP) type, or a liquid crystal on silicon (LCOS) display type, with a resolution of at least 640×480 pixels, for example. An IR cut filter 86*b* can be mounted in front of the projector lens of video projector 70 to prevent IR light emitted by the video projector from entering the interior of the interactive display table housing where the IR light might interfere with the IR light reflected from object(s) on or above interactive display surface 64*a*. Video projector 70 projects light along dotted path 82*a* toward a first mirror assembly 72*a*. First mirror assembly 72*a* reflects projected light from dotted path 82*a* received from video projector 70 along dotted path 82*b* through a transparent opening 90*a* in frame 62, so that the reflected projected light is incident on a second mirror assembly 72*b*. Second mirror assembly 72*b* reflects light from dotted path 82*b* along dotted path 82*c* onto translucent layer 64*b*, which is at the focal point of the projector lens, so that the projected image is visible and in focus on interactive display surface 64*a* for viewing.

Alignment devices 74*a* and 74*b* are provided and include threaded rods and rotatable adjustment nuts 74*c* for adjusting the angles of the first and second mirror assemblies to ensure that the image projected onto the display surface is aligned with the display surface. In addition to directing the projected image in a desired direction, the use of these two mirror assemblies provides a longer path between projector 70 and translucent layer 64*b* to enable a longer focal length (and lower cost) projector lens to be used with the projector. In some alternate implementations, an LCD panel or an organic light emitting display (OLED) panel can be employed instead of a video projector to produce an image.

The foregoing and following discussions describe an interactive display device in the form of interactive display table 60 and 60'. Nevertheless, it is understood that the interactive display surface need not be in the form of a rectangular or square shape. The principles described in this description suitably also include and apply to display surfaces of different shapes such as circular or oval.

Listener Positions around Interactive Display System

Figure 4B:
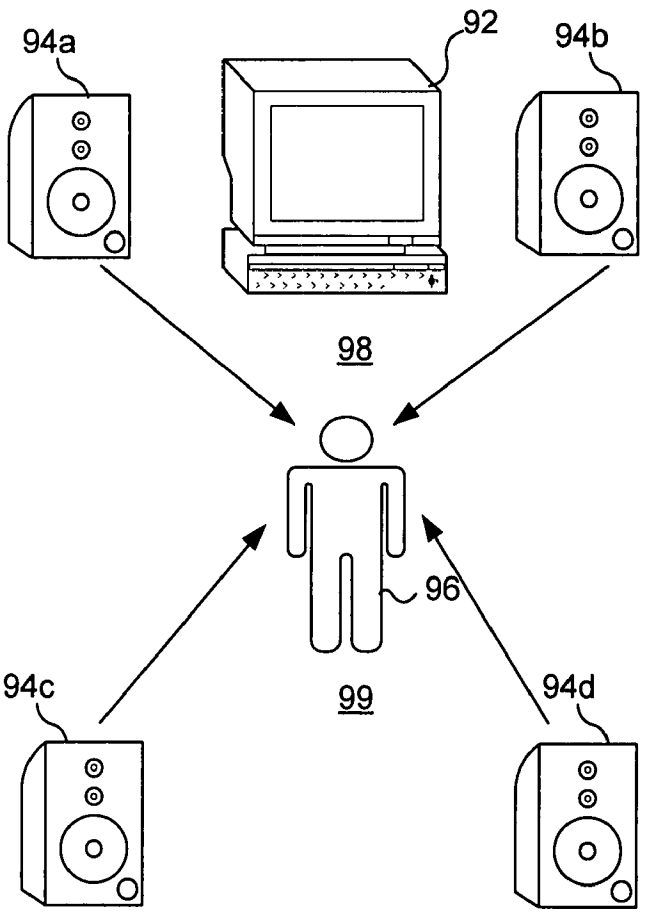
FIG. 4B (PRIOR ART)
FIG. 4B (Prior Art) is a functional block diagram of a conventional four-speaker sound system for use with a PC, showing the user positioned in front of a conventional monitor display, centered relative to the four speakers.
Figure 4A:
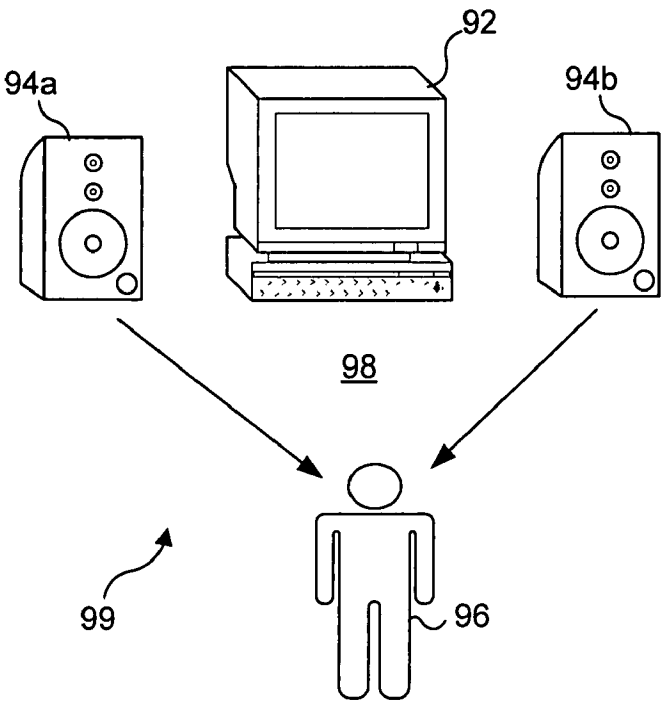
FIG. 4A (PRIOR ART)
FIG. 4A (Prior Art) is a functional block diagram of a conventional two-speaker sound system for use with a PC, showing the user positioned in front of a conventional monitor display, centered relative to the two speakers.
Figure 5:
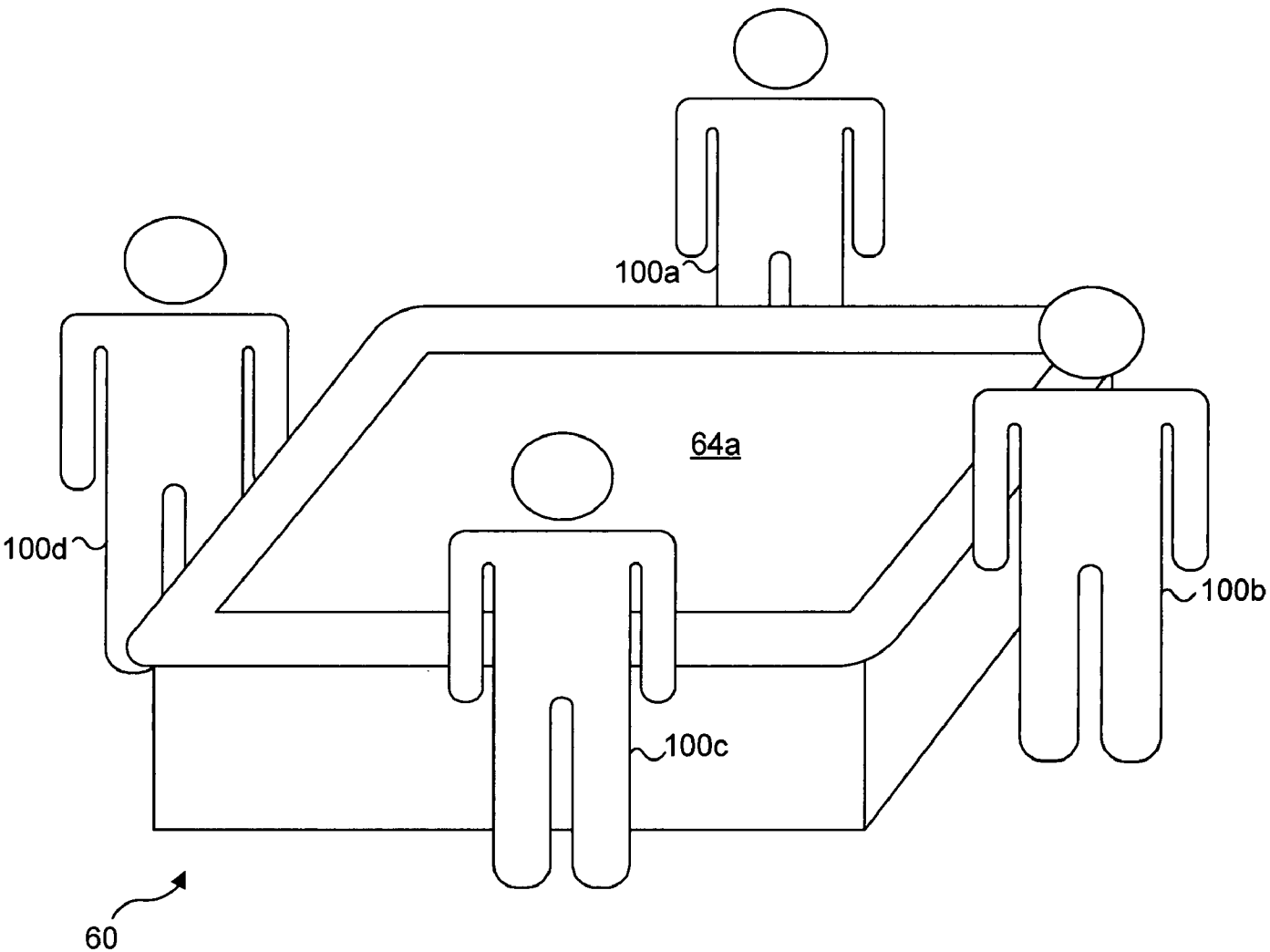
FIG. 5 illustrates an interactive display system with four users, each disposed at a different side of the interactive display surface.

FIG. 5 illustrates an interactive display table 60, which is exemplary of an interactive display system having an interactive display surface 64*a* that is generally horizontal and comprises the top surface of the interactive display system. In this exemplary embodiment, the interactive display surface is generally rectangular in shape, but as noted above, it is also contemplated that an interactive display surface having a different shape might alternatively be used. As shown in this Figure, four users 100*a*, 10*b*, 100*c*, and 100*d* are disposed at spaced apart points around interactive display surface 64*a*. Although the users can be disposed at other positions around the interactive display surface, in this Figure, each user is shown generally at the center of one of the ends or of one of the sides of the interactive display table. Unlike the prior art arrangement for positioning speakers relative to a listener who is disposed in front of a vertical display monitor shown in FIGS. 4A and 4B, a user of the interactive display system can be disposed along any of the ends or sides of interactive display table 60. Accordingly, an entirely different arrangement for producing an acoustic sound field that is consistent with predefined criteria has been developed to ensure that the direction of the sound field produced will generally correspond to a user's expectations, as explained below. These predefined criteria can depend on several different conditions related to the use of the interactive display surface by one or more users, as will be evident from the explanation that follows.

Alternative Embodiments for Mounting Speakers

FIGS. 6A and 6B respectively illustrate two different embodiments for mounting four speakers on interactive display table 60. In FIG. 6A, speakers 102*a*, 102*b*, 102*c*, and 102*d* are each mounted to the housing of the interactive display table around interactive display surface 64*a*, so that each speaker is generally centered in one of the sides or ends of the housing (and mounted below the interactive display surface). In this schematic view, the speakers appear to extend outwardly of interactive display table 60 and to be mounted along the top edge, but it will be understood that the speakers are actually mounted nearly flush with the sides or ends of the housing supporting the interactive display surface, and below the interactive display surface. Curved lines are shown radiating out from the front of each speaker, to indicate the direction in which a sound field produced by the speaker radiates outwardly.

In the exemplary embodiment of FIG. 6B, four speakers 104*a*, 104*b*, 104*c*, and 104*d* are each respectively mounted at a different corner around and under interactive display surface 64*a*. Again, for the sake of illustration, the speakers are shown as if extending outwardly of the top edge of the interactive display table housing, but instead, the speakers are mounted below the interactive display surface and generally within the extent of the housing. The curved lines disposed in front of each speaker are again intended to show the direction in which an audible sound field radiates outwardly from the speaker (and from the interactive display table).

User Position can Determine Speakers Selectively Energized by PC

Figure 7A:
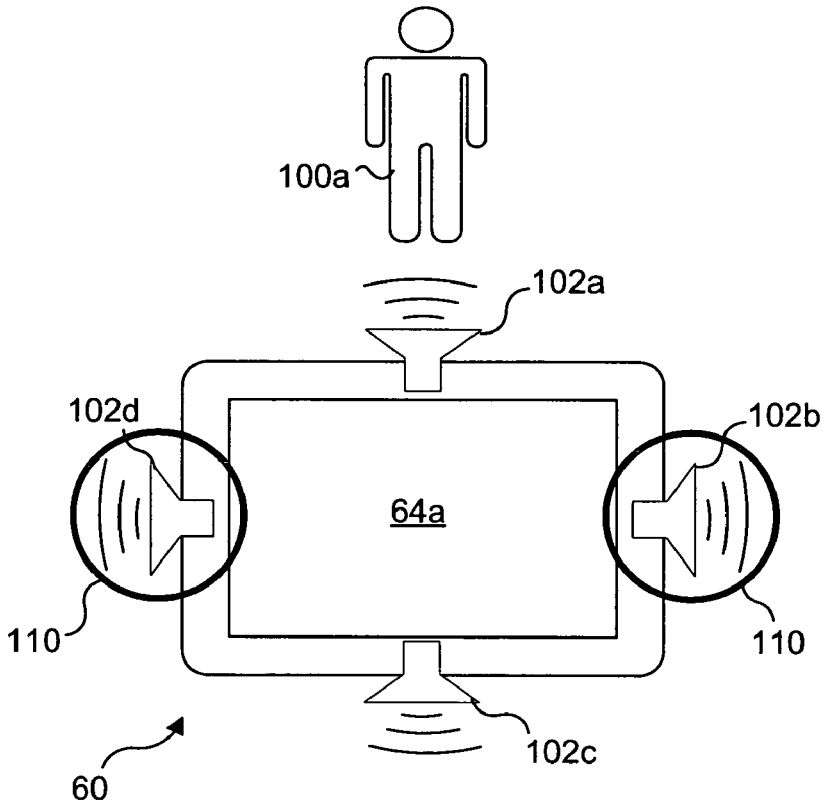
FIGS. 7A and 7B illustrate the embodiment of FIG. 6A, showing the speakers that can be selectively energized to provide an appropriate sound field for a user disposed along one side of the interactive display surface, and at one end of the interactive display surface, respectively.
Figure 7B:
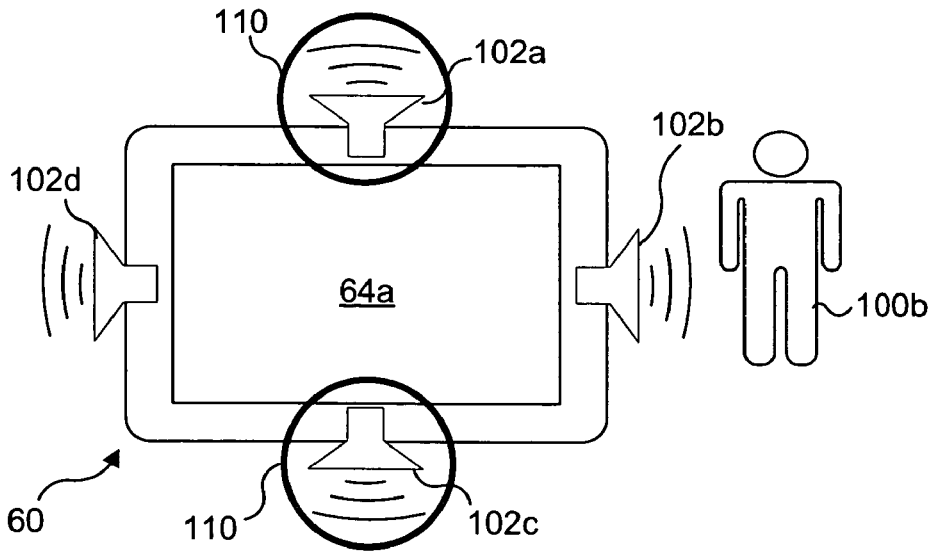

FIGS. 7A and 7B illustrate two examples showing how speakers can be selectively energized by PC 20 in regard to the disposition of the user toward whom the sound field produced by the speakers should logically be directed. In FIG. 7A, a stereo sound field is produced in regard to user 100*a* by energizing speakers 102*b* and 102*d* with different stereo drive signals, as indicated by circles 110 in the Figure. In a conventional sound system (Prior art) as depicted in FIG. 4A or 4B, the left stereo channel would be played through speaker 94*a* and the right stereo channel through speaker 94*b*. In contrast, when instead played on an interactive display system in regard to user 100*a*, the left stereo channel would be played through speaker 102*b* and the right stereo channel would be played through speaker 102*d*. The resulting sound field provides a listening experience to user 100*a* matching use of a conventional sound system because the interactive display table has reacted to the user's position between speakers 102*b* and 102*d*. Alternatively, for a monophonic sound field, the same speakers can be energized using an identical drive signal. As a further alternative when playing monophonic sound, only speaker 102*a* can be energized.

Similarly, in FIG. 7B, to produce an appropriate sound field for user 100*b*, speakers 102*a* and 102*c* can be selectively energized to produce either a stereophonic or a monophonic sound field (as indicated by circles 110), depending on whether the drive signals employed are different stereo signals or the same monophonic signals. Alternatively, only speaker 102*b* might be energized to produce a monophonic sound field. The disposition of one or more users around the interactive display table can be determined in regard to a current state of a software application that is being executed by the interactive display system, or in response to a user input provided by a user interacting with the interactive display surface, as described in greater detail below. For example, if a user begins interacting with the interactive display surface from a specific location, the direction of the sound field comprising audio sounds produced by the speakers mounted within the interactive display table in regard to that user should be consistent with the position of the user. The PC will thus selectively energize speakers to achieve that result. When another user begins to interact with a software application, the PC will energize speakers to produce a sound directed relative to that other user.

If two or more users are playing an electronic game using the interactive display system, the positions of each user may be initially determined by the software or predefined in regard to the rules of the game, so that as each user successively becomes the focus of the game software, the appropriate speakers will be selected by the PC to direct the sound field at that user. If the players take turns so that the currently active user is the next user moving clockwise around the interactive display table, the speaker or speakers that must be energized to direct the sound field at the current active user will be selectively energized. It is also contemplated that the currently active user in a game or other software application might be identified by having the PC selectively energize the appropriate one or more speakers to direct the sound field at that user.

Figure 8A:
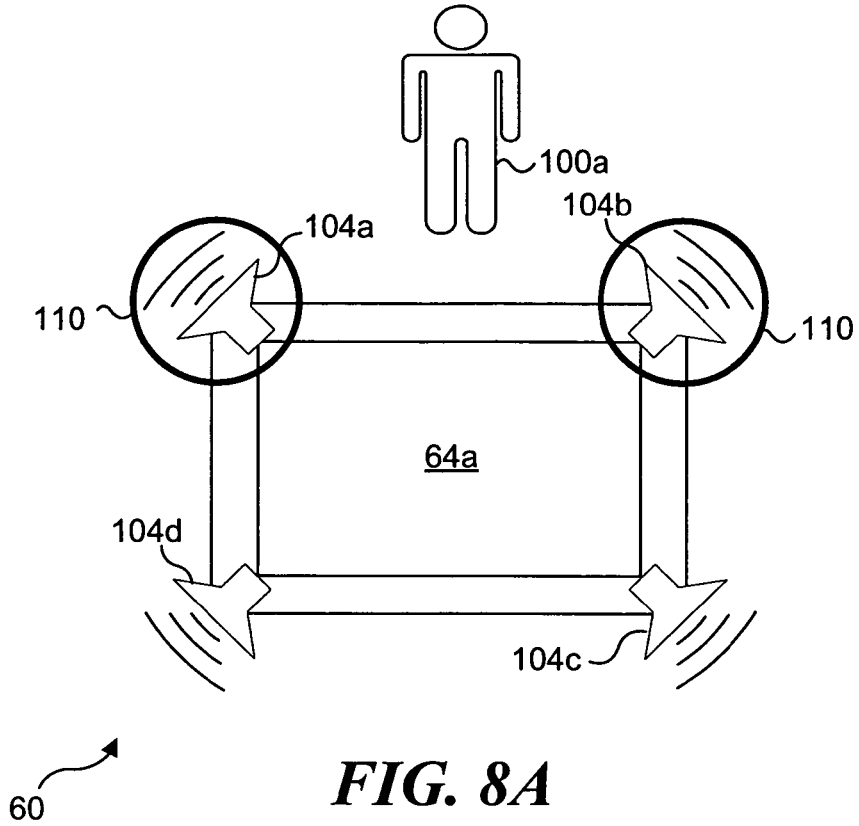
FIGS. 8A and 8B illustrate the embodiment of FIG. 6B, showing the speakers that can be selectively energized to provide an appropriate sound field for a user disposed along one side of the interactive display surface, and at one end of the interactive display surface, respectively.
Figure 8B:
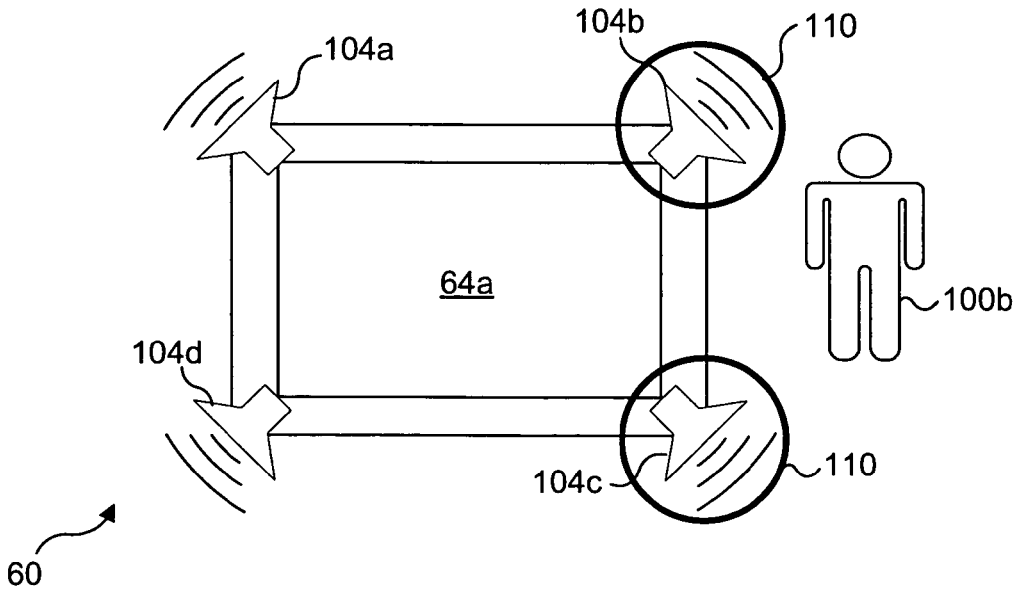

FIGS. 8A and 8B illustrate the speakers that are selected in regard to the disposition of a current user, for the embodiment shown in FIG. 6B, to provide an appropriate sound field for the user. In FIG. 8A, to provide an appropriate sound field for user 100*a*, speakers 104*a* and 104*b* are energized as indicated by circles 110. These two speakers can be energized with drive signals that produce either a stereophonic or a monophonic sound field appropriate for user 100*a*. In FIG. 8B, speakers 104*b* and 104*c* are energized, again as indicated by circles 110, to produce either a stereophonic or monophonic sound field appropriate for user 100*b*. To produce stereophonic sound, each of the two speakers illustrated in FIGS. 8A and 8B are driven with different stereo drive signals, while to produce a monophonic sound field, the two speakers are driven with an identical drive signal.

Each of the above illustrations indicate how a single user is provided an appropriate sound field, based upon the position of the user around the interactive display table. However, in many cases, more than one user will be disposed as points around the interactive display table. One or more users can be involved in interacting with a single software application executing on the interactive display system. Alternatively, as illustrated in FIGS. 9A and 9B, each user may be interacting with a different software application executing on the interactive display system. FIG. 9A illustrates one example (in connection with the embodiment of FIG. 6A) in which user 100*b* is interacting with one software application, while user 100*d* is interacting with a different software application. The software application being used by a specific user thus provides an appropriate sound field for user 100*b*, by selectively energizing speaker 102*b*, as indicated by circle 110 that is immediately in front of the user. Similarly, a sound field produced by the software application being used by user 100*d* causes a sound field to be directed toward user 100*d* from speaker 102*d*, as indicated by the circle 110 disposed in front of the user.

FIG. 9B illustrates an example in connection with the embodiment of FIG. 6B. In this example, user 100*a* is interacting with one software application, which produces a sound field directed consistent with the disposition of user 100*a*, by selectively energizing speakers 104*a* and 104*b*. The different application being used by user 100*d* causes speakers 104*a* and 104*d* to be selectively energized to produce the sound intended for user 100*d*. Thus, speaker 104*a* is selectively energized with the drive signals for the sound field intended for both users 100*a* and 100*d*. To avoid an undesired cacophony of sound, PC 20 can selectively energize the speakers to produce a sound field directed to each of these two users at different times, thereby delaying the production of the sound intended for one user relative to that intended for the other user. In this way, the sound field experienced by each user should be more clearly distinguished.

Another example is illustrated in FIG. 9C, which includes the speaker configuration shown in FIG. 6B. This example illustrates how speakers 104*a* and 104*b* are selectively energized to produce sound fields appropriate for two users 100*e* and 100*f*, who in this example, are disposed along a common side (or edge) of the interactive display table. Both of these users are positioned between speakers 104*a* and 104*b*, but user 100*e* is closer to speaker 104*a*, while user 100*f* is closer to speaker 104*b*. Both users may be interacting with the software application being executed by the interactive display system, or with different software applications executed by the interactive display system. Since user 100*e* is closer to speaker 104*a*, a sound 110*e* (corresponding to the software application with which user 100*e* is then interacting) produced by speaker 104*a* is louder in volume than the volume of the related sound produced by speaker 104*b*. Similarly, since speaker 104*b* is closer to user 100*f*, a sound 110*f* produced by speaker 104*b* (corresponding to the software application with which user 100*f* is then interacting) is louder in volume than the volume of the related sound 110*f* produced by speaker 104*a*. The speakers that are thus selectively energized in regard to users 100*e* and 100*f* and their volume levels are thus logically controlled consistent with the dispositions of users 100*e* and 100*f*, and consistent with the sound that each should hear relative to the state of the respective user's interaction with software being executed by the interactive display system for the respective user.

FIG. 10 illustrates how predefined criteria are used to determine the speakers that are selectively energized to produce a sound field directed to each of three different users 100*a*, 100*b*, and 100*d*. In this example, the software application executing on the interactive display system might be a game in which each user takes a turn in a defined order and direction, so that the speakers selected by PC 20 are energized to produce the sound field directed to a specific user, when that user is to have a turn in the game. Thus, when user 100*a* has a turn, speaker 102*a* is selectively energized to produce a sound field directed to that user, as indicated by a dotted line circle 114. Similarly, when user 100*b* is interacting with the software executing on the interactive display system, speaker 102*b* is selectively energized, as indicated by a dash line circle 112. And, when user 100*d* is to have a turn at the game, the software selectively energizes speaker 102*d*, as indicated by circle 110. The predefined criteria controlling the speaker that is currently energized by the PC is thus defined by the software application relative to the user who is supposed to currently have a turn within the rules of that application.

Predefined Criteria Determined by Virtual Object

FIGS. 11A and 11B respectively illustrate examples for the embodiments of FIGS. 6A and 6B, showing how the disposition of a virtual object being displayed on interactive display surface 64*a* is employed as the predefined criteria for determining the speakers that are selectively energized and the volume of the speakers to produce a sound field that is consistent with a user's expectation of the sound field that would be produced by such an object, given its current position on the interactive display surface. In FIG. 11A, for the embodiment of FIG. 6A, the image of a race car 118 is produced on interactive display surface 64*a* and the race car moves to indicate that the race car is being driven around a track 120. Race car 118 is shown currently disposed near the corner of the interactive display surface, at a point approximately equidistant from speakers 102*c* and 102*d*. Accordingly, speakers 102*c* and 102*d* are selectively energized and as illustrated produce a sound (such as an appropriate deep-throated engine noise) at approximately the same volume level, as indicated by circles 110. In contrast, speakers 102*a* and 102*b*, which are substantially farther from race car 118 than speakers 102*c* and 102*d*, also produce the sound of the engine, but at a substantially lower volume level, as indicated by lighter circles 116. As the race car moves, the sound levels produced by each selectively energized speaker are adjusted so that the sound produced appears to be consistent with the motion of the race car around the track.

FIG. 11B illustrates the preceding example as applied in connection with the embodiment of FIG. 6B, to determine the speakers that are energized and/or the relative volume levels of the sound produced by each of the speakers that is selectively energized. In this example, since race car 118 is closest to speaker 104*d*, that speaker produces the sound of the engine noise at the loudest volume level, as indicated by very dark circle 122. Speaker 104*a* is the next closest speaker to the current position of race car 118 and also produces the sound of the engine noise, but at a lower volume level, as indicated by a circle 124. Similarly, speaker 104*c* is the next closest to the race car and produces the engine noise at a slightly lower volume level than speaker 104*a*, as indicated by a lighter circle 116. Speaker 104*b* may not be energized, or alternatively, may be selectively energized to produce the sound of the engine noise at the same or a lower volume level as speaker 104*c*, as indicated by lighter circle 116. As another alternative, PC 20 may selectively energize only the speaker that is then closest to the race car as the race car moves around track 120, but the effect would be less realistic than changing the relative volume levels of the sounds signal produced by the different speakers that are selectively energized, consistent with the changing position of the race car as it tours the track and as a function of its relative distance from the speakers.

Those of ordinary skill in the art will appreciate that a virtual object can be associated with various sounds so that different speakers are selectively energized to produce the sounds in accord with different criteria that are generally consistent with a user's expectations of how the sounds should relate to a current position or state of a virtual object being displayed on the interactive display surface. As the position or state of the virtual object changes, the sound produced by the speakers that are selectively energized can thus be made to change in a consistent manner.

Determining a User's Position to Control Speakers Energized

As noted above, the disposition of the user can comprise the predefined criteria employed to determine which of the speakers should be selectively energized to produce a sound field directed toward that user. FIGS. 12A, 12B, and 12C illustrate three different examples for the two different embodiments of FIGS. 6A and 6B, showing how the disposition of a currently active user can be determined so that the appropriate speaker(s) can be selectively energized to produce a sound field directed to that user.

FIG. 12A illustrates the embodiment of FIG. 6B. In this example, the user selectively touches the interactive display surface or moves a finger proximate to interactive display surface 64*a*, at a point 130. Point 130 might correspond to an image of a control that is being displayed, or the user may be responding to an instruction to touch the interactive display surface in that nominal location. The disposition of the user's finger at this point provides an input to a software application being executed by PC 20. The PC detects the touch or hover of the finger at this point, as explained above. The application can then determine the nominal position of the user by extending a line 134 from a center 132 of the interactive display surface, outwardly through point 130. It is assumed that the user providing the input is disposed next to the interactive display table along line 134. As a result, PC 20 selectively energizes speakers 104*c* and 104*d*, as indicated by circles 110. The sound field produced by these two selected speakers can be either stereophonic or monophonic, depending upon the software application being executed and the drive signal that it provides.

Similarly, FIG. 12B illustrates how this determination is made and employed for the embodiment of FIG. 6A. As explained above, a user provides an input with a finger at a point 136. A line 138 is thus extended from center 132 of the interactive display surface through point 136. The software application assumes that the user is disposed along line 138, next to the interactive display table. Accordingly, the software application selectively energizes speaker 102*a* and speaker 102*c*, as indicated by circles 110. Typically, this approach would be used if the two speakers that are selectively energized are producing a stereophonic sound field, but could also be employed for producing a monophonic sound field. Alternatively, as shown in FIG. 12C, a monophonic sound field could be produced by selectively energizing speaker 102*b*, as indicated by circle 110, since that speaker is directly in front of the assumed position of the user.

While each of the three preceding examples has shown an input by a user placing a finger in contact with or proximate to the interactive display surface, it should be understood that a user can provide an input by positioning an object in contact with or proximate to the interactive display surface. In either case, it is the disposition or point at which the input is detected that enables the software application to determine a disposition of the user and thus, to selectively energize specific one or more speakers to produce an appropriate sound field for the user providing the input.

Logic Implemented in Selecting One or More Speakers Energized

FIG. 13 illustrates a flowchart 150 showing the logic that is carried out by PC 20 in applying one or more different predefined criteria that can be employed to selectively energize one or more speakers on the interactive display system. In this exemplary logic, a block 152 indicates that the logic determines the predefined criteria that will be applied to control the speaker selection.

Three different predefined criteria are shown in this example. As indicated in a block 154, one of the predefined criteria comprises the location of one or more current active users around the interactive display table. As discussed above, it is contemplated that one or more users may be interacting with a single software application being executed by the interactive display system. Alternatively, two or more users may each be running a different software application on the interactive display system. In either case, for each software application that is being executed, the processor will need to determine the position of a current active user, for example based upon the input by the user, as noted in a block 160. The technique for determining the nominal position of a user based upon an input by the user moving an object such as a finger or a game piece into contact with the interactive display surface or proximate thereto, has been discussed above. In response to such an input, as indicated in a block 162, the logic can selectively energize either a speaker in front of the currently active user that just provided the input, or alternatively, can selectively energize speakers on each side of that user.

A block 164 indicates that the speakers that are energized can be changed based upon changes related to the predefined criteria. For example, the predefined criteria being applied may change, which may thereby change the speakers that are energized. Alternatively, the conditions for a specific predefined criteria can change, also causing these speakers that are selectively energized to change in a consistent manner.

For example, as an active user changes based upon the input of another user on the interactive display surface, step 162 could cause a different one or more speakers to be energized for a new active user.

Different predefined criteria are indicated in a block 156. In this block, one or more active software applications defines one or more speakers that are selectively energized, consistent with a state of the software application or with its expectations regarding the currently active user. For example, as discussed above, if the software application is an electronic game being executed by the interactive display system, the rules of the game may specify that the currently active user change, rotating in a predefined direction, e.g., clockwise around the interactive display table. Thus, the one or more speakers that are selectively energized by the software application will be determined so as to direct a sound field produced by playing sound files that are part of the game software toward the user that the software application expects to then be currently active. The original location of the users playing the game might be initially specified when the game software is setting up play.

A block 166 indicates that the software application thus controls the speakers that are selectively energized in regard to the currently active one or more users, as defined by the software application. In some cases, it may be appropriate to energize more than one speaker to direct sound fields toward all of the users participating in the software application, or toward each user comprising a subset of the users. Following block 166, the logic proceeds to block 164, which provides for changing the one or more speakers that are selectively energized, as discussed above.

A third type of predefined criteria is indicated in a block 158. In this block, the current location or state of a virtual object appearing to be a source of the sound that will be produced comprises the predefined criteria for controlling the one or more speakers that are energized. As explained above, in connection with the race car virtual object shown in FIGS. 11A and 11B, the relative distance between each of the speakers on the interactive display table and the virtual object "producing" the sound can be applied in selecting the speakers that are energized and/or controlling the relative volume of sound produced by each speaker that is selectively energized. A block 168 indicates that the speaker(s) selectively energized (and/or their relative volume levels) are determined by the software application consistent with either a current location or a current state of the virtual object.

It will be apparent that a change in state of a virtual object can affect the speakers that are selectively energized. For example, when the race car comes to a stop and its engine is switched off, the speakers energized to produce an engine noise will be deenergized, reflecting the change in state of the race car. Accordingly, the logic is thereby carrying out the step indicated in block 164, since there has thus been a change in a condition related to the predefined criteria identified in block 158.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

The invention in which an exclusive right is claimed is defined by the following:

1. A method for creating an audible sound field for an interactive display system that includes an interactive display surface that is generally horizontal, around which one or more users may be disposed at different locations, comprising the steps of:

physically coupling more than two audio sources to the interactive display system, at spaced-apart points around the interactive display surface, so as to produce audible sound directed outwardly relative to a periphery of the interactive display surface;

determining a location of a user, who is currently interacting with the interactive display surface, relative to the interactive display surface, and wherein the location of the user is determined from a plurality of different possible location from which the user can interact with the interactive display surface; and based upon at least the determined position of the user relative to the interactive display surface, selectively energizing a first combination of at least one specific audio source of the more than two audio sources, so as to create an audible sound field that is logically associated with at least the determined location of the user relative to the interactive display surface, and wherein the at least one specific audio source is energized so as to generally center the audible sound field about the disposition of the user and wherein a different combination of one or more of the more than two audio sources will be selectively energized when the user is determined to be located at a different location of the plurality of different locations relative to the interactive display surface.

2. The method of claim 1, wherein the step of determining the position of the user comprises the step of responding to an input by the user occurring through an interaction with the interactive display surface that provides an indication of the position of said user relative to the interactive display surface.

3. The method of claim 2, wherein the step of determining the position of the user further comprises:

(a) detecting an object positioned by the user at least proximate a point on the interactive display surface that is generally adjacent to the position of the at least one user; and (b) determining that the user is positioned along a line extending from a center of the interactive display surface outwardly through the point.

4. The method of claim 1, wherein the step of energizing comprises the steps of effecting one of the following (a) or (b):

(a) energizing an audio sound source that is generally positioned on a line that extends from the center of the interactive display surface through the position of the user; and (b) energizing two audio sound sources that are positioned on opposite sides of the line that extends from the center of the interactive display surface through the position of the user.

5. The method of claim 1, wherein the step of selectively energizing further comprises the steps of:

(a) detecting a position on the interactive display surface of a virtual object that is being displayed by a software application, the virtual object being associated with an audible sound controlled by the software application; and (b) in response to the position of the virtual object on the interactive display surface, selectively energizing at least one audio sound source so that the audible sound associated with the virtual object appears to be emanating from the virtual object.

6. The method of claim 5, wherein the method further comprises changing the at least one audio sound source that is energized to produce the audible sound so that a point from which the audio sound appears to emanate moves consistently with a motion of the virtual object over the interactive display surface, the method further comprising the step of selectively setting a volume level of the audible sound produced by each audio sound source that is selectively energized, to correspond to a relative distance between the virtual object and the audio sound source.

7. The method of claim 1, wherein the step of selectively energizing comprising the step of energizing two audio sound sources at different relative volume levels to produce a user-specific audio sound at a louder volume by one of the two audio sound sources that is closer to the user than by the other of the two audio sound sources that is farther from the user.

8. An interactive display system that produces an audible sound field, comprising:

(a) a housing that supports a generally horizontal interactive display surface around which one or more users may be disposed at different locations, the interactive display surface both displaying text and images, as well as responding to input to the interactive display system by a user interacting with the interactive display surface with an object;

(b) at least three audio sound sources that can each be selectively energized to produce audible sound, each of the audio sound sources being supported by the housing at spaced apart positions around the interactive display surface;

(c) an amplifier that is coupled to the at least three audio sound sources, the amplifier providing a drive signal to each audible source that is to be selectively energized, causing the audible source to produce audible sound; and (d) a computing device that is coupled to the amplifier to provide source signals that are amplified by the amplifier to produce drive signals supplied to selectively drive the audio sound sources, the computing device selectively controlling the audio sources that are energized, wherein the computing device implements a method that includes determining a location of a user who is currently interacting with the interactive display surface and, based upon the user's location relative to the interactive display surface, selectively energizing a first combination of at least one of the audio sound sources, so as to create an audible sound field that is logically associated with at least the location of the user, and wherein the at least one of the audio sound sources is energized so as to generally center a corresponding audible sound field about the location of the user, and such that a different combination of the audio sources will be selectively energized when the user is determined to be located at a different location relative to the interactive display surface.

9. The system of claim 8, wherein the computing device determines the location of the at least one user in response to a position where the at least one user interacts with the interactive display surface to provide an input.

10. The system of claim 9, wherein the computing device further determines the location of the at least one user around the interactive display surface by:

(a) detecting an object positioned by the at least one user on the interactive display surface; and (b) determining that the at least one user is disposed along a line extending from a center of the interactive display surface outwardly through the point.

11. The system of claim 8, wherein the computing device effects one of the following (a) and (b):

(a) selectively energizing an audio sound source that is generally disposed on the line that extends from a center of the interactive display surface through the location of the user; and (b) selectively energizing two audio sound sources that are disposed on opposite sides of the line that extends from the center of the interactive display surface through the location of the user.

12. The system of claim 8, wherein the computing device also selectively energizes the at least one audio sound source by:

(a) detecting a disposition on the interactive display surface of a virtual object that is being displayed by a software application, the virtual object being associated with an audible sound controlled by the software application; and (b) in response to the disposition of the virtual object on the interactive display surface, selectively energizing the at least one of the audio sound sources so that the audible sound associated with the virtual object appears to be emanating from the virtual object.

13. The system of claim 12, wherein the computing device changes a volume level of the audio sound produced by the at least one specific audio source that is energized so that a point from which the audio sound appears to emanate moves consistently with a motion of the virtual object over the interactive display surface.

14. The system of claim 12, wherein the computing device selectively energizes the audio sound sources as a function of a distance of each audio sound source from the current position of the virtual object, so that an audio sound source that is closer to the current position of the virtual object produces a greater volume of the audio sound than an audio sound source that is substantially further away from the current position of the virtual object, on the interactive display surface.

15. An interactive display sound system, comprising:

(a) a generally horizontal interactive display surface mounted in a top of a housing, the interactive display surface displaying images and responding to input by a user positioning an object at least proximate to the interactive display surface;

(b) at least four audio sound sources disposed within the housing at spaced-apart locations, so that an audible sound field produced when any of the audio sound sources is energized, is directed outwardly of the housing in a defined direction; and (c) a sound signal source that selectively energizes a first combination of at least one of the audio sound sources based upon an identified location of at least one user who is interacting with the interactive display surface and such that a sound field produced by energizing one or more selected sound sources in the first combination is directed towards the at least one user, consistent with the identified location of the at least one user relative to the interactive display surface, and such that a different combination of the audio sources will be selectively energized when the user is determined to be located at a different location relative to the interactive display surface.

16. The interactive display sound system of claim 15, wherein the location of the at least one user relative to the interactive display surface is determined in response to an input by a user at a point at least proximate to the interactive display surface that is offset from a center of the interactive display surface.

17. The interactive display surface sound system of claim 15, wherein in response to the location of the user, the sound signal selectively identifies an audible signal source that is located closest to a line that extends from a center of the interactive display surface through the location of the user; and Selectively energizes the audible signal source that is located closest to the line.

18. The interactive display surface sound system of claim 15, wherein as the virtual object moves over the interactive display surface, the sound signal source selectively energizes the audio sound sources so that an audio sound source that is closer to the virtual object produces a louder audible sound corresponding to the virtual object, and an audio sound source that is farther from the virtual object produces a softer audible sound corresponding to the virtual object.

19. The interactive display surface sound system of claim 15, wherein the sound field produced by energizing one or more selected sound sources and that is directed towards the at least one user is also consistent with a location of a virtual object displayed on the interactive display surface that appears to produce an audible sound consistent with a location of the virtual object on the interactive display surface.

20. The interactive display surface sound system of claim 15, wherein the one or more selectively energized sound sources are directly outwardly from the interactive display surface towards the at least one user.

* * * * *